US008677708B2

(12) United States Patent
Williams

(10) Patent No.: US 8,677,708 B2
(45) Date of Patent: Mar. 25, 2014

(54) WALL, ROOF AND BUILDING STRUCTURES

(75) Inventor: Michael H. Williams, LaPorte, IN (US)

(73) Assignee: A&A Sheet Metal Products, Inc., LaPorte, IN (US)

( * ) Notice: Subject to any disclaimer, the term of this patent is extended or adjusted under 35 U.S.C. 154(b) by 0 days.

(21) Appl. No.: 12/827,428

(22) Filed: Jun. 30, 2010

(65) Prior Publication Data

US 2012/0000139 A1 Jan. 5, 2012

(51) Int. Cl.
*E04B 2/00* (2006.01)
*E04B 5/00* (2006.01)
*E04B 9/00* (2006.01)

(52) U.S. Cl.
USPC ..... 52/506.01

(58) Field of Classification Search
USPC ..... 52/11, 302.1, 404.1, 506.01
See application file for complete search history.

(56) References Cited

U.S. PATENT DOCUMENTS

| | | | | |
|---|---|---|---|---|
| 2,150,997 | A | | 3/1939 | Venzie |
| 2,492,422 | A | | 12/1949 | Govan |
| 3,031,044 | A | | 4/1962 | Stitt et al. |
| 3,217,456 | A | | 11/1965 | Quigg et al. |
| 3,678,642 | A | * | 7/1972 | Scott ..... 52/588.1 |
| 4,107,891 | A | * | 8/1978 | Cotton et al. ..... 52/394 |
| 4,501,101 | A | * | 2/1985 | Davis ..... 52/404.3 |
| 4,628,826 | A | | 12/1986 | Richter |
| 4,759,165 | A | * | 7/1988 | Getoor et al. ..... 52/528 |
| 4,817,355 | A | | 4/1989 | Tilsley et al. |
| 5,870,867 | A | * | 2/1999 | Mitchell ..... 52/220.1 |
| 6,182,407 | B1 | | 2/2001 | Turpin et al. |
| 6,627,561 | B1 | | 9/2003 | Wulliman et al. |
| 6,742,315 | B2 | | 6/2004 | Linn |
| 2002/0088199 | A1 | | 7/2002 | Linn |

* cited by examiner

*Primary Examiner* — Mark Wendell
(74) *Attorney, Agent, or Firm* — Barnes & Thornburg LLP

(57) ABSTRACT

A wall structure includes first and second panels joined to form a stud and a first wall layer. A fastener extends through the first wall layer and into the stud. Each panel includes first and a second ends. The first end of one panel and the second end of the other panel form a portion of the stud. The ends of the panels can nest. The wall structure can include multiple wall layers arranged such that the seams formed by components of each wall layer are staggered with respect to the seams in adjacent wall layers. Reinforcing members and fasteners can secure the wall layers to the remainder of the structure. A similarly constructed roof structure can be joined with multiple wall structures to form a building.

15 Claims, 9 Drawing Sheets

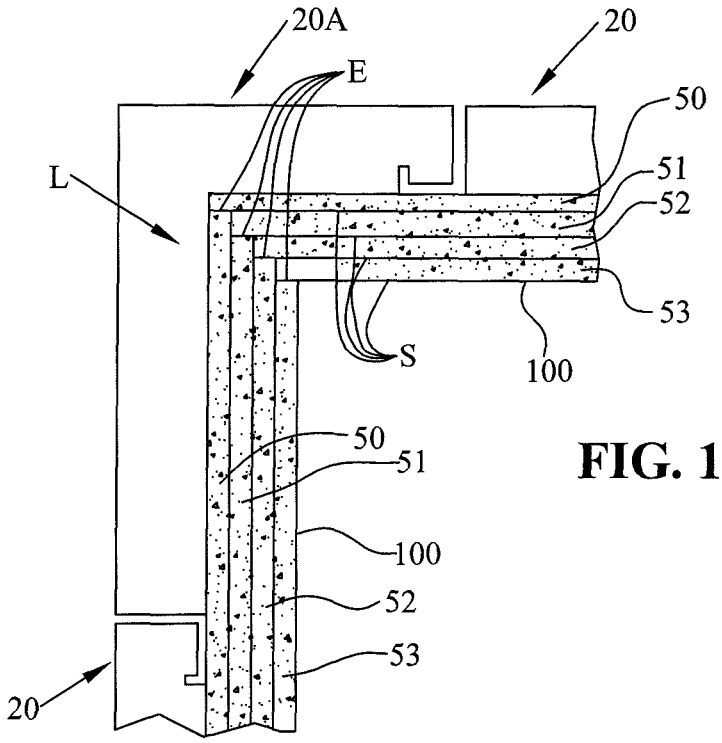
FIG. 10
FIG. 11
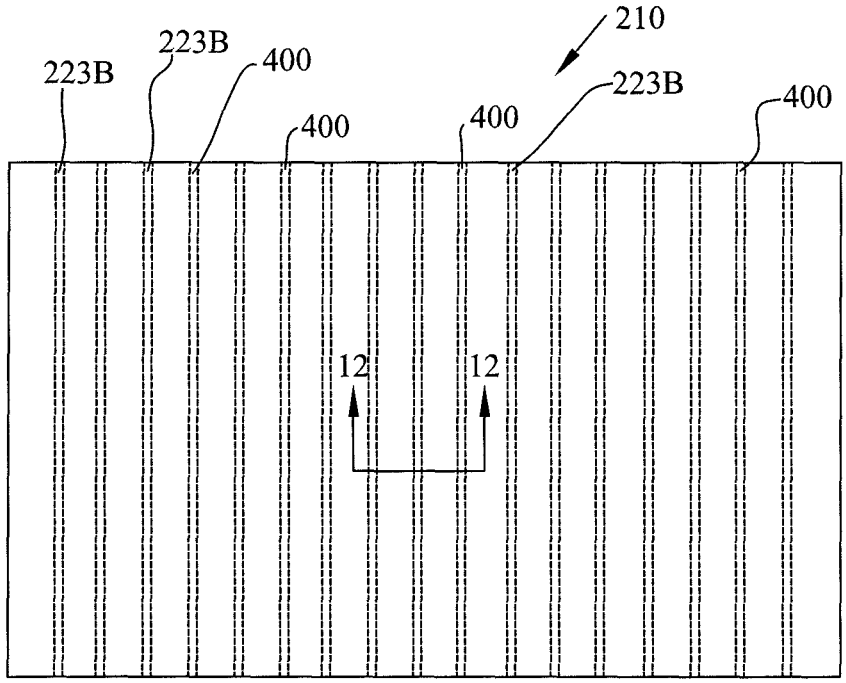

WALL, ROOF AND BUILDING STRUCTURES

The present invention relates to wall, roof and building structures. In particular, the structures of the present invention are useful in applications where a high degree of fire retardant performance is desirable or required.

Numerous building and wall construction systems are known in the prior art. Examples of such systems are shown in U.S. Pat. No. 3,031,044 to Stitt, et al., U.S. Pat. No. 4,628,826 to Richter, U.S. Pat. No. 4,817,355 to Tilsley, et al., U.S. Pat. No. 6,182,407 to Turpin, et al. and U.S. Patent Application Publication No. 2002/0088199A1 to Linn.

BACKGROUND AND SUMMARY OF THE INVENTION

In one embodiment of the invention, a wall structure includes a first panel, a second panel joined to the first panel to form a stud and a first wall layer. A fastener extends through the first wall layer and into the stud. Each panel includes a first end and a second end. The first end of one panel and the second end of the other panel can form at least a portion of the stud. The first and second ends of the panels have generally J-shaped configurations in one embodiment of the invention. The ends of the panels can nest to form a portion of the stud. The wall structure can include multiple wall layers arranged such that the seams formed by the ends of individual members of one wall layer are staggered with respect to the seams formed by individual members of the adjacent wall layers. Reinforcing members and fasteners can be used to secure the wall layers to the remainder of the wall structure.

In one embodiment of the invention, multiple wall structures can be joined to form the walls of a building. The building can include first and second wall structures. The second wall can have a third panel perpendicular to the first panel of the first wall. The building can include a fourth panel joining the first and third panels. In one embodiment, the first wall layer includes an end and an inwardly facing surface, the second wall includes a second wall layer having an end and an inwardly facing surface and the end of the first wall layer abuts the inwardly facing surface of the second wall layer. In another embodiment, the first wall includes a third wall layer having an end an inwardly facing surface, the second wall includes a fourth wall layer having an end and an inwardly facing surface and the end of the third wall layer abuts the inwardly facing surface of the fourth wall layer.

In another embodiment of the invention, a roof structure includes a first panel, a second panel joined to the first panel to form a stud and a first roof layer. A fastener extends through the first roof layer and into the stud. Each panel includes a first end and a second end. The first end of one panel and the second end of the other panel can form at least a portion of the stud. The first and second ends of the panels have generally J-shaped configurations in one embodiment of the invention. The ends of the panels can nest to form a portion of the stud. A second fastener can extend through the first end of the first panel and the second end of the second panel. The roof structure can include multiple roof layers arranged such that the seams formed by the ends of individual members of one roof layer are staggered with respect to the seams formed by individual members of the adjacent roof layers. Reinforcing members and fasteners can be used to secure the roof layers to the remainder of the roof structure. The roof structure can also include a gutter. In another embodiment of the invention, the first roof layer has a first end and the roof structure further includes a second roof layer having a first end. The first end of the first roof layer and the first end of the second roof layer are staggered with respect to the first end of the first panel.

In one embodiment of the invention, the roof structure can be joined to wall structures of the present invention to form a building. The various roof and wall layers can be staggered such that the ends of one abut inwardly facing surfaces of the other at the juncture of the roof structure and the wall structures.

BRIEF DESCRIPTION OF THE DRAWINGS

FIG. 10 is a partial sectional view of a building corner formed by two wall structures of FIG. 1.

FIG. 11 is a top plan view of a roof structure according to one embodiment of the present invention.

DETAILED DESCRIPTION OF THE PREFERRED EMBODIMENTS

Figure 1:
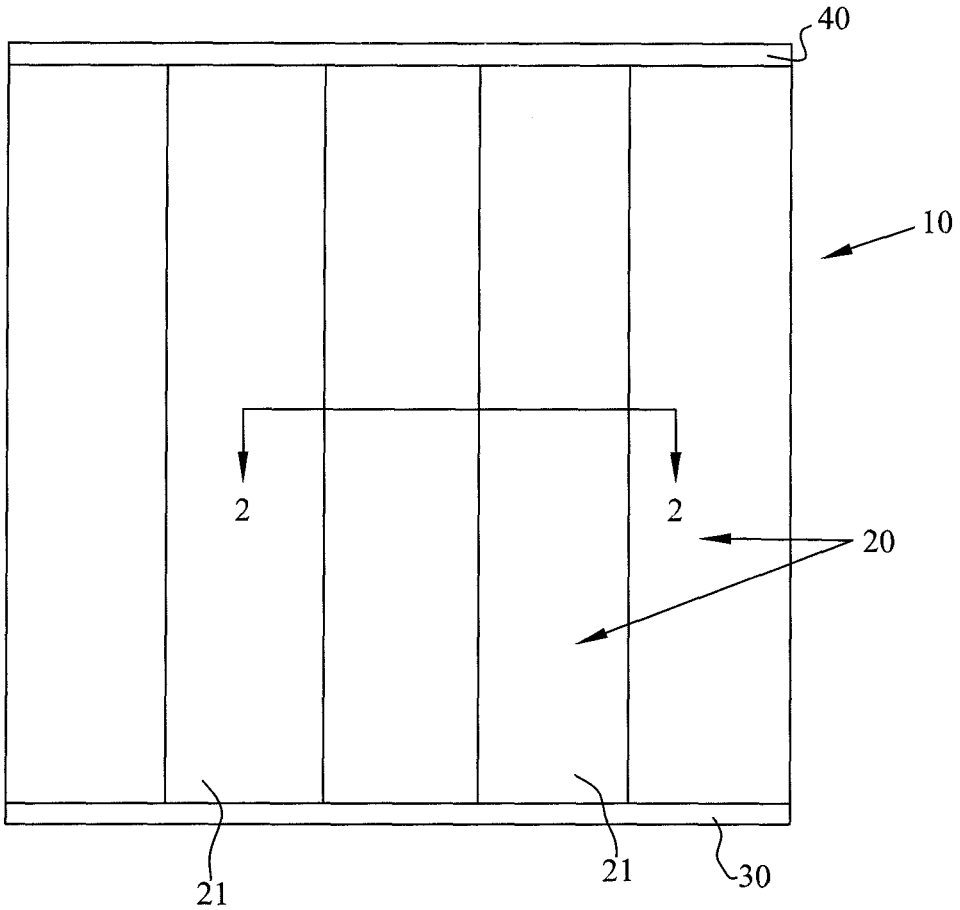
FIG. 1 is an outer elevational view of a wall structure according to one embodiment of the present invention.

FIG. 1 is an outer elevation view of a wall structure according to one embodiment of the present invention. The section of the wall structure 10 shown in FIG. 1 includes a plurality of panels 20, a lower frame member 30 and an upper frame member 40. Each panel 20 includes and outer surface 21.

Figure 2:
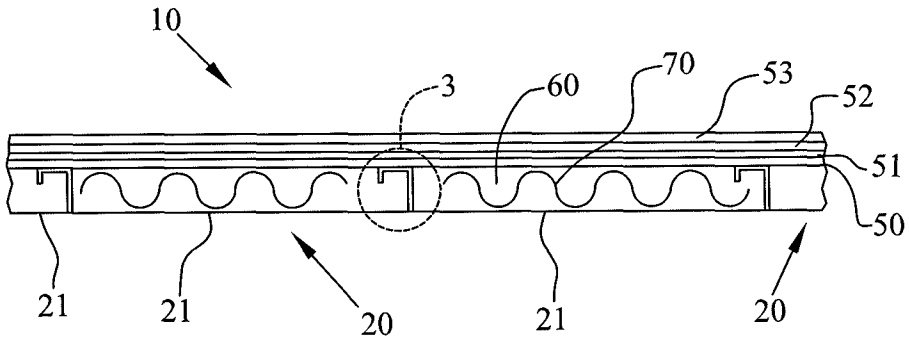
FIG. 2 is a cross-sectional view taken along line 2-2 in FIG. 1.
Figure 3:
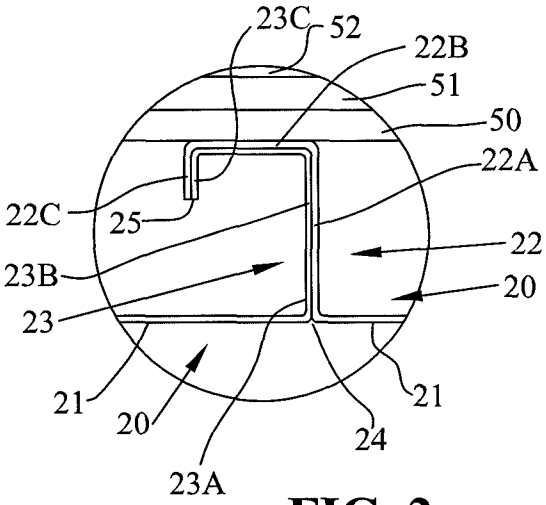
FIG. 3 is an enlarged view of the section indicated in FIG. 2.

Referring to FIGS. 2 and 3, each panel 20 includes a first end 22 and a second end 23. First end 22 of each panel 20 includes a generally J-shaped member formed by a first segment 22A extending generally perpendicular to surface 21, a second segment 22B extending generally perpendicular to first segment 22A and a third segment 22C extending generally perpendicular to second segment 22B and generally parallel to first segment 22A. Similarly, second end 23 includes a first segment 23A generally perpendicular to surface 21, a second segment 23B generally perpendicular to first segment 23A and a third segment 23C generally perpendicular to second segment 23B and generally parallel to first segment 23A. As shown in FIG. 3, first end 22 and second end 23 of adjacent panels 20 form a nested configuration in which second end 23 is positioned within first end 22 and surfaces 21 of the adjacent panels 20 are aligned to form a substantially planar surface. In this manner, first ends 22 and second ends 23 form studs, which can receive fasteners for joining wall layers to panels 20 as described below. Adjacent panels 20 may be joined together in various manners. In one embodiment of the invention, adjacent panels 20 are welded at locations 24 and 25. Panels 20 may be continuously welded along their height or tack welded at intervals. In certain embodiments of the invention, panels 20 are 12 or 16 gauge galvannealed steel sheets.

As shown in FIG. 2, the wall structure further includes a first wall layer 50, a second wall layer 51, a third wall layer 52 and a fourth wall layer 53. In one embodiment of the invention, wall layers 50, 51, 52 and 53 are three-quarter inch thick gypsum drywall sheets. Wall layers 50, 51, 52 and 53 are secured to panel sections 20 as described below. As further shown in FIG. 2, there is a space 60 between first wall layer 50 and panels 20 in which insulation 70 may optionally be placed.

Figure 4:
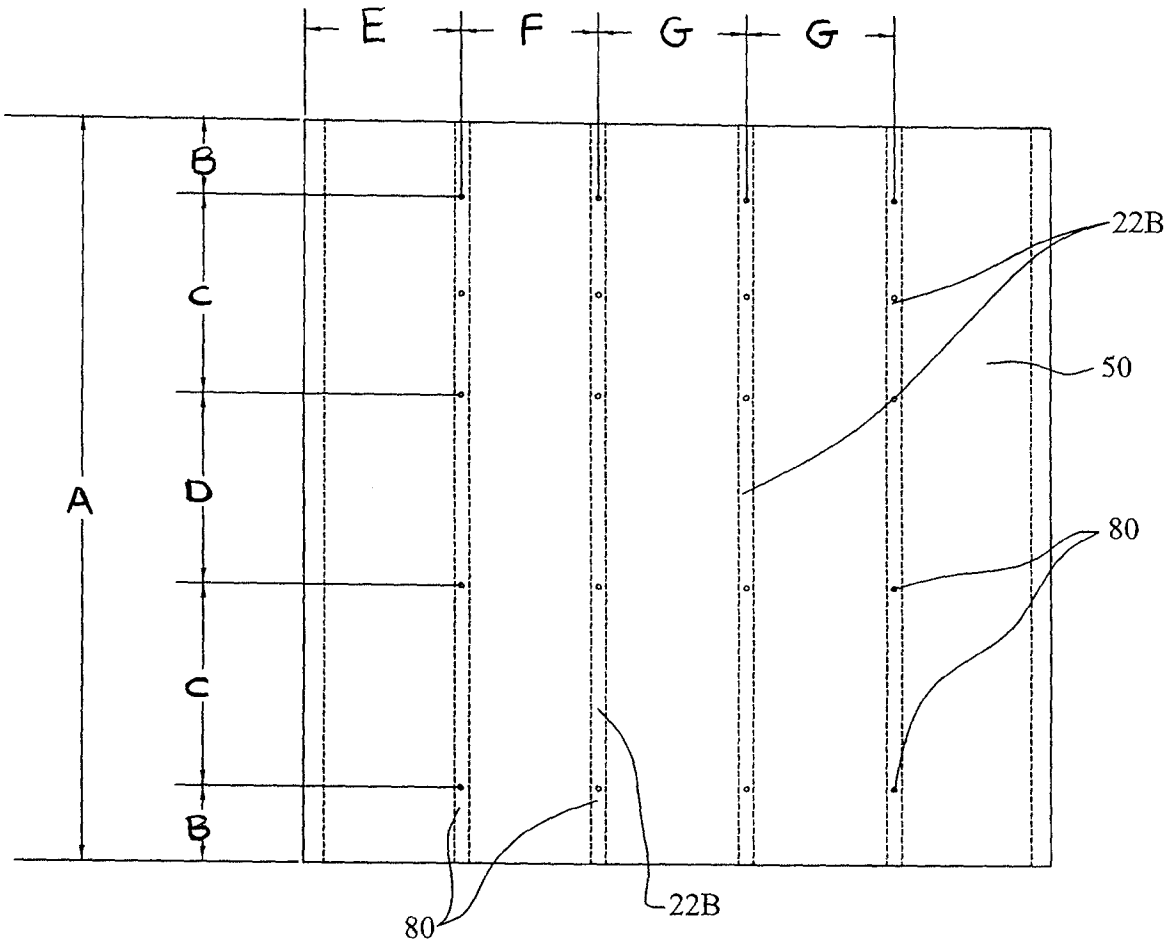
FIG. 4 is an interior elevation view of a first wall layer applied to the wall structure of FIG. 1.
Figure 6:
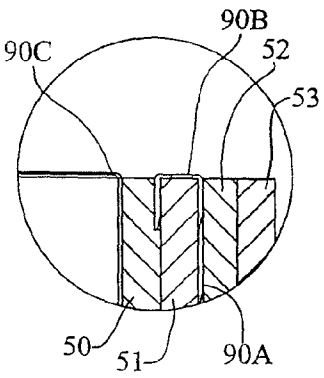
FIG. 6 is an enlarged end view of the wall structure shown in FIG. 1.

Turning to FIG. 4, first surfacing member or wall layer 50 is secured to panels 20 by inserting a plurality of fasteners through first wall layer 50 and into second segment 22B of wall panels 20. In a preferred embodiment, a type F drywall fastener is used and extends through both second segment 22B of first end 22 and second segment 23B of second end 23. FIG. 4 further shows the specific fastener placement for first wall layer 50 according to one embodiment of the invention.

In FIGS. 4, 5, 6, 7, 8 and 9, the distance corresponding to the reference letters is as follows:

A 119.75 in.
B 12.00 in.
C 32.00 in.
D 31.75 in.
E 24.93 in.
F 22.00 in.
G 24.00 in.
H 18.15 in.
I 29.88 in.
J 12.39 in.
K 20.98 in.
L 20.00 in.
M 13.39 in.
N 22.98 in.
O 15.00 in.
P 29.83 in.
Q 29.87 in.
R 30.04 in.
S 19.17 in.
T 28.41 in.
U 31.35 in.
V 31.34 in.
W 11.75 in.
X 22.96 in.
Y 22.02 in.
Z 48.00 in.

Figure 5:
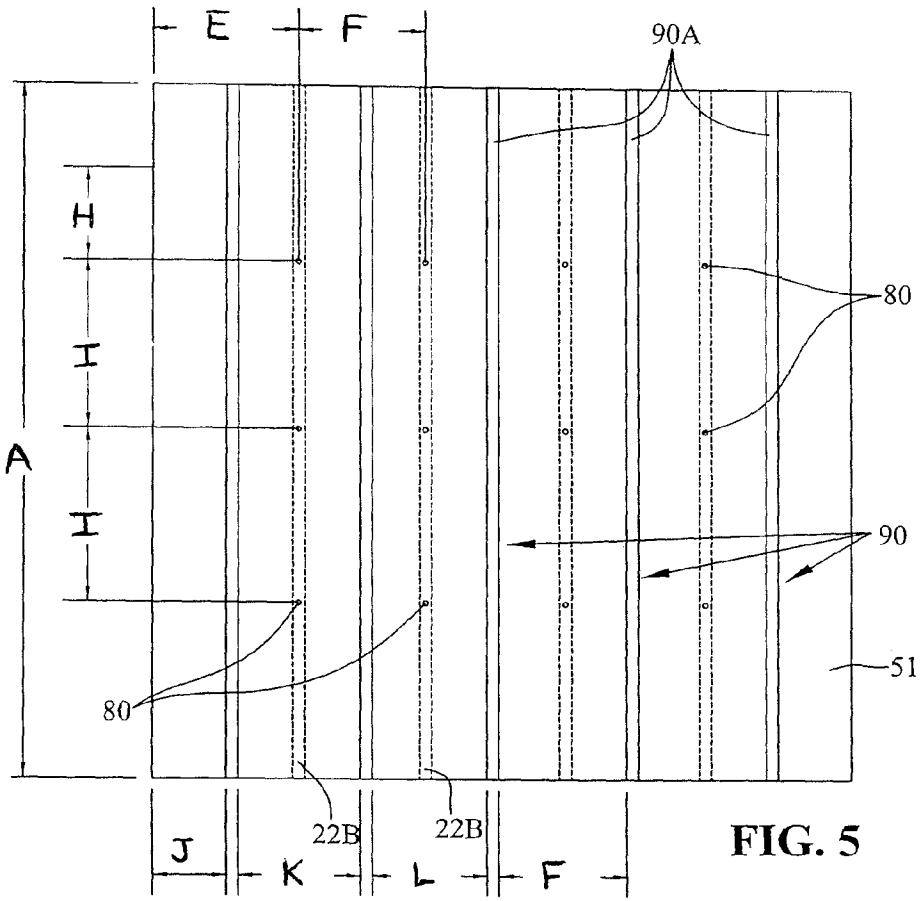
FIG. 5 is an interior elevation view of a second wall layer applied to the wall structure of FIG. 1.

FIG. 5 shows the placement of fasteners 80 used to secure second surfacing member or wall layer 51 to the remainder of the wall structure 10. As further shown in FIGS. 5 and 6, a plurality of reinforcing members 90 are positioned on second wall layer 51. Each reinforcing member 90 includes a first segment 90A substantially equal in height to second wall layer 51, a second segment 90B generally perpendicular to first segment 90A and a third segment 90C generally perpendicular to second segment 90B and generally parallel to first segment 90A. Reinforcing members 90 are secured to wall structure 10 by positioning them such that first segment 90A is positioned on one surface of second wall layer 51 and third segment 90C is positioned on the opposite side of second wall layer 51 and adjacent first wall layer 50. In one embodiment of the invention, reinforcing members 90 are two inch wide 16 gauge steel straps.

Figure 7:
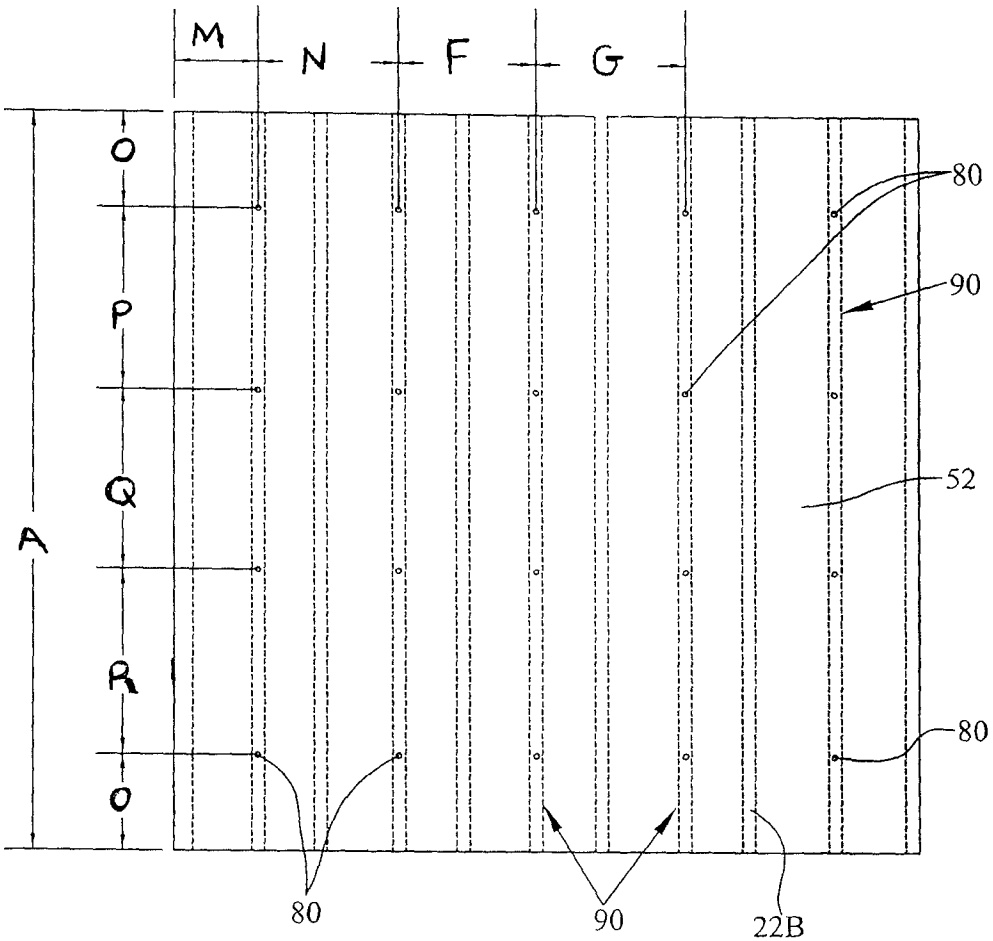
FIG. 7 is an interior elevation view of a third wall layer applied to the wall structure of FIG. 1.
Figure 8:
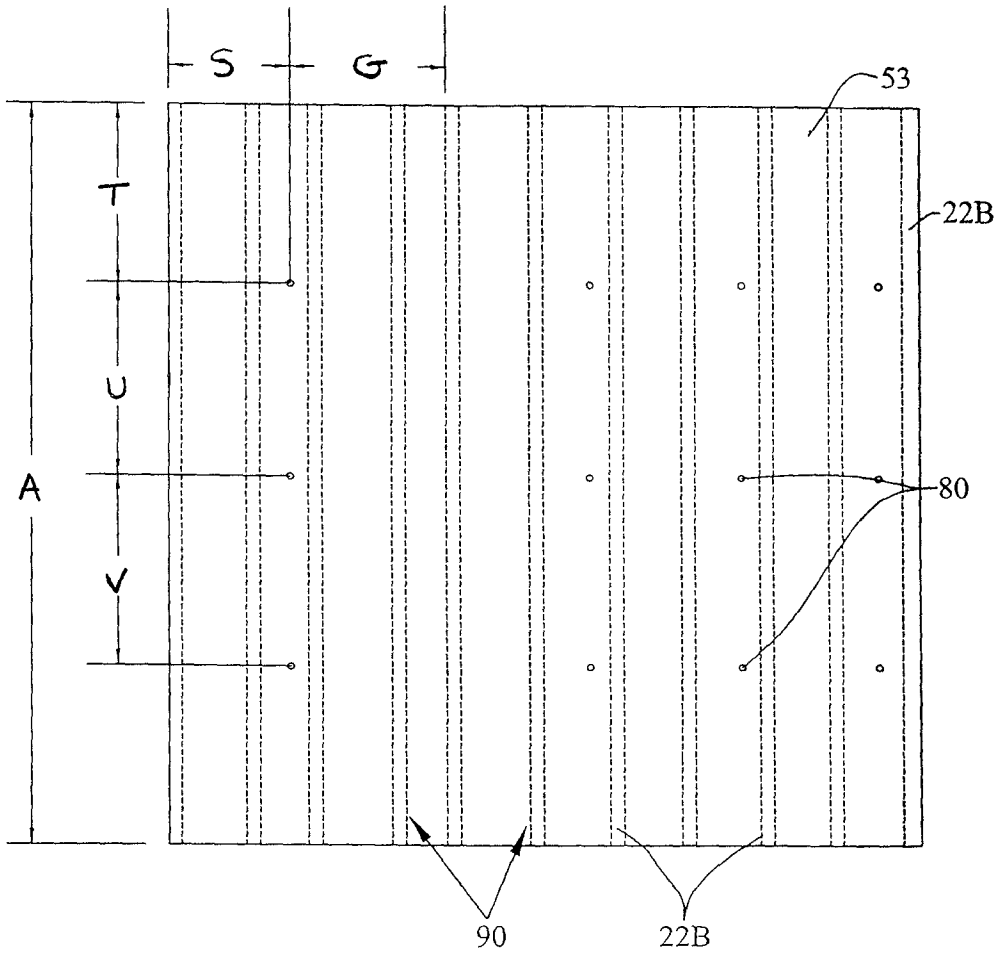
FIG. 8 is an interior elevation view of a fourth wall layer applied to the wall structure of FIG. 1.

FIG. 7 shows the position of fasteners 80 used to secure third surfacing member or wall layer 52 to the remainder of the structure. In this instance, fasteners 80 are inserted through wall layer 52 and into reinforcing members 90. FIG. 8 shows the placement of fasteners 80 for securing fourth surfacing member or wall layer 53 to the remainder of the structure 10.

Figure 9:
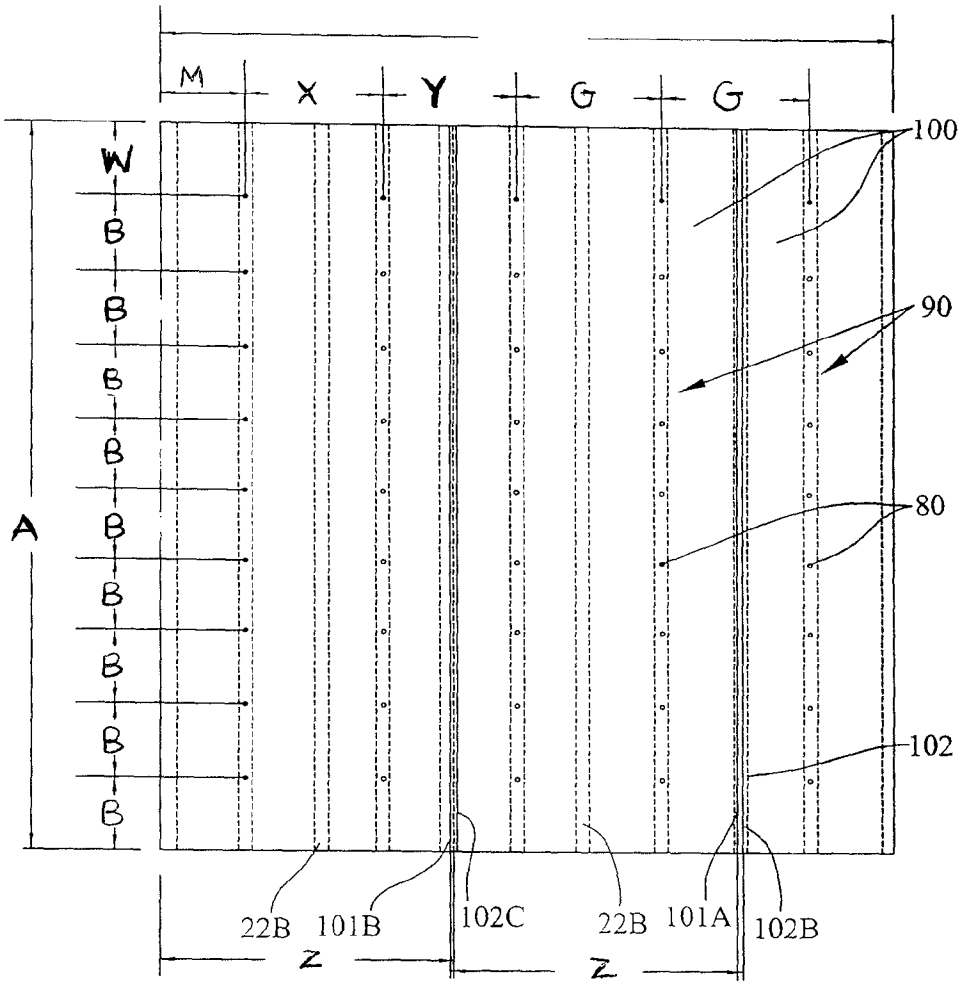
FIG. 9 is an interior elevation view of an interior surfacing material that has been attached to the wall structure of FIG. 1.

Referring to FIG. 9, a plurality of interior wall surfacing members or layers 100 are shown attached to fourth wall layer 53. Surfacing members 100 are attached by inserting fasteners 80 into reinforcing members 90 as shown. Note that in the embodiment described, the seams formed by two adjacent members of one wall layer are staggered with respect to the seams formed by two adjacent members of the subsequent wall layer. The same is true of the surfacing members 100. For example, surfacing members 100 are arranged such that the seam formed by end 101A of one surfacing member 100 and end 102B of an adjacent surfacing member 100 are staggered with respect to the seams formed by adjacent members of the underlying wall layer 52. The same is true of the seams formed by ends 101 and 102C of surfacing members 100. In one embodiment of the invention, surfacing members 100 are 18 gauge steel sheets.

FIG. 10 is a partial sectional view showing two wall structures 10 joined at a 90° angle to form a building corner. As shown in FIG. 10, a first panel 20 from one wall structure 10 and a second panel 20 from another wall structure 10 are joined by a corner panel 20A. Each end of corner panel 20A includes a generally J-shaped member for nesting with corresponding J-shaped members on panels 20 in the manner described above. As further illustrated in FIG. 10, wall layers 50, 51, 52 and 53 are staggered at the corner such that ends E of one set of wall layers 50, 51, 52 and 53 abut inwardly facing surfaces S of the other set of wall layers 50, 51, 52 and 53 so as to mate as shown at location L.

Figure 12:
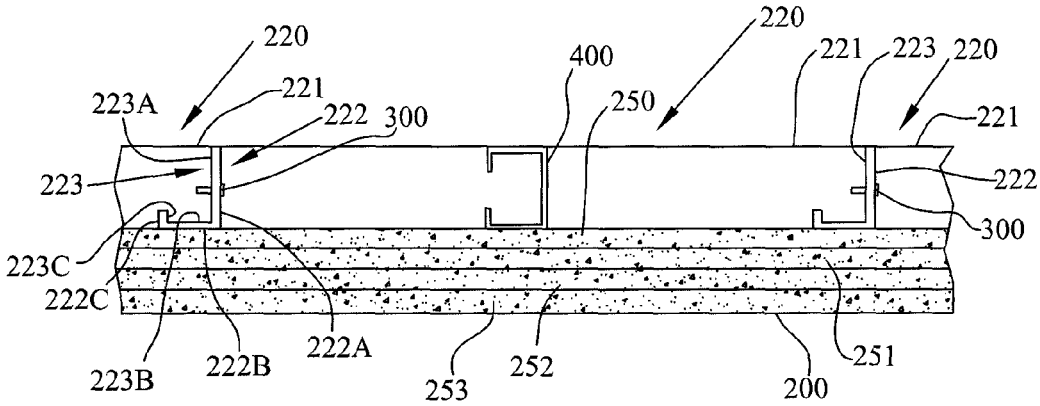
FIG. 12 is a partial cross-sectional view taken along line 12-12 in FIG. 11.

FIG. 11 is a top plan view of a roof structure 210 according to one embodiment of the present invention. FIG. 12 is a partial cross-sectional view taken along line 12-12 in FIG. 11. As shown in FIGS. 11 and 12, roof structure 210 is constructed in a manner similar to that of wall structure 10. Roof structure 210 includes a plurality of panels 220 having outer surfaces 221 and first and second generally J-shaped nesting ends 222 and 223. First ends 222 include a first segment 222A extending generally perpendicular to surface 221, a second segment 222B extending generally perpendicular to first segment 222A and a third segment 222C extending generally perpendicular to second segment 222B and generally parallel to first segment 222A. Second ends 223 includes a first segment 223A generally perpendicular to surface 221, a second segment 223B generally perpendicular to first segment 223A and a third segment 223C generally perpendicular to second segment 223B and generally parallel to first segment 223A. Note that in the embodiment shown, ends 222 and 223 are joined by a plurality of fasteners 300 extending through segments 222A and 223A. Roof structure 210 further includes a first roof layer 250, a second roof layer 251, a third roof layer 252 and a fourth roof layer 253. Roof layers 250, 251, 252 and 253 may be ¾ inch thick gypsum drywall sheets and may be secured to panel sections 20 in the same manner as described with respect to wall structure 10 above. Roof structure 210 may also include surfacing members 2100 such, as 18 gauge steel sheets. In the embodiment shown, roof structure 210 further includes a plurality of generally C-shaped reinforcing members 400 located between first ends 222 and second ends 223 of panels 220 and between panels 220 and first roof layer 250. Reinforcing members 400 may be attached to panels 220 and roof sections 250 in any one of a number of manners, such as by an appropriate fastener. Reinforcing members 400 may also be welded to upper frame members 40 of wall structures 10 when roof structure 210 is assembled to a plurality of wall structures 10 to form a building structure as described below.

Figure 13:
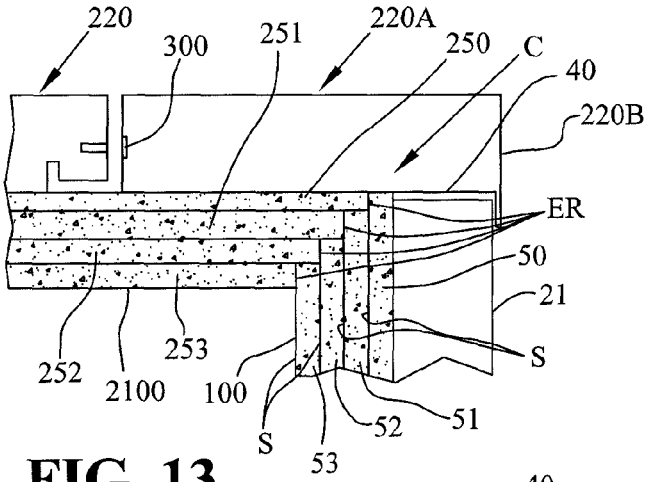
FIG. 13 is a partial sectional view of a building at a location formed by a wall structure of FIG. 1 and a roof structure of FIG. 11.

Wall structures 10 can be assembled to a roof structure 210 to form a building structure. FIG. 13 shows a partial sectional view of and upper corner of such a building structure looking in the same direction as the sectional view of FIG. 12. As shown in FIG. 13, wall layers 50, 51, 52 and 53 and roof layers 250, 251, 252 and 253 are staggered along the juncture of wall structure 10 and roof structure 210 such that ends ER of roof layers 250, 251, 252 and 253 abut inwardly facing surfaces S of wall layers 50, 51, 52 and 53 so as to mate as shown at location C. As also shown in FIG. 13, a corner panel 220A includes a substantially J-shaped end for mating with an adjacent panel 220 in the manner described above and includes a second end 220B that extends beyond outer surface 21 of the panel 20 and extends downwardly adjacent top frame member 40. End 220B can be secured to top frame member 40 by welding or appropriate fasteners.

Figure 14:
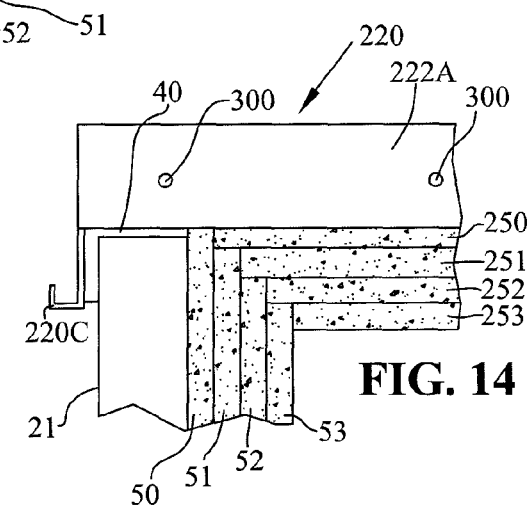
FIG. 14 is a partial sectional view perpendicular to the view of FIG. 13 of a building at a location formed by a wall structure of FIG. 1 and a roof structure of FIG. 11.

FIG. 14 shows a partial sectional view of an upper corner of a building structure formed by a roof structure 210 and wall structures 10 as viewed in the direction perpendicular to that shown in FIG. 13. As shown in FIG. 14, panels 220 may be provided with an optional gutter structure 220C.

A building constructed from wall structures 10 and roof structure 210 can also include a plurality of doors and windows as desired, which can be framed and installed in a number of known manners. Note also that caulk or other sealants can be applied as desired to various locations where the panels meet and/or fasteners are utilized to weatherproof the structure.

Although the present invention has been shown and described in detail, the same is for purposes of illustration only and is not a limitation on the invention. Numerous modifications to the invention can be made. Fourth wall layer 53 and/or fourth roof layer 253 can be omitted. If so, the structures will not provide as much fire protection as the embodiments with four layers. For example, the embodiment of the invention that includes fourth wall layer 53 has received approval from Factory Mutual Insurance Company (a/k/a FM Global) for a four hour fire rating. The embodiment that excludes fourth wall layer 53 has received approval from FM Global for a two hour fire rating. Similarly, the embodiment of the invention that includes fourth roof layer 253 has received approval from FM Global for a three hour fire rating. Note also that FIGS. 4,5 and 7-9 show the approximate maximum spacing in inches for the fasteners (which is the same for the roof and wall layers) for the embodiment shown, which meets these fire performance characteristics. However, the spacing can be varied above and below those indicated within the scope of embodiments of the invention. The embodiment that omits fourth roof layer 253 has received approval for a one and a half hour fire rating. The reinforcing members can also be eliminated from the three wall layer embodiment. Also, the reinforcing members do not have to be straps or C-shaped channels as described above. Any of a number of reinforcing member can be utilized. Similarly, different types of fasteners can also be used. It is not necessary that all of the fasteners are of the same type. In yet another embodiment of the invention, all four wall and roof layers can be eliminated. In this embodiment, surfacing members 100 and 2100 are connected directly to panels 20 and 220. A structure constructed from this embodiment would have a very limited fire retardant properties but could be used as a storage facility or storm shelter. This embodiment of the present invention meets the current FM Global standard for storing flammable and combustible liquids. Also, the wall structure of the present invention can be joined to roof structures other than that of the present invention. Similarly, the roof structure of the present invention can be joined to wall structures other than those of the present invention. Accordingly, the scope of the invention is to be limited only by the terms of the appended claims.

Numerous other changes can be made to the embodiments shown without departing from the scope of the invention. The application is, therefore, intended to cover any variations, uses, or adaptations of the invention using its general principles. Further, this application is intended to cover such departures from the present disclosure as come within known or customary practice in the art to which this invention pertains.

What is claimed is:

1. A building having:
a roof; and
a first wall including:
a first panel having a first end and a second end;
a second panel having a first end and a second end, a portion of the second end of the first panel and a portion of the first end of the second panel being positioned adjacent each other to form a stud; and
a first wall layer including an end surface and an inwardly facing surface perpendicular to the end surface;
a fastener extending through the first wall layer, the portion of the second end of the first panel that forms the stud and the portion of the first end of the second panel that forms the stud;
a second wall having:
a third panel perpendicular to the first panel of the first wall; and
a second wall layer having an end surface and an inwardly facing surface perpendicular to the end surface, the end surface of the first wall layer abutting the inwardly facing surface of the second wall layer and being parallel thereto; and
a fourth panel joining the first and third panels.

2. The building according to claim 1, wherein the second end of one panel nests within the first end of the other panel.

3. The building according to claim 1, wherein the first end of one panel has a substantially J-shaped configuration.

4. The building according to claim 1, wherein the first panel includes a first surface and the first end includes a first segment extending generally perpendicular to the first surface.

5. The building according to claim 4, wherein the first end of the first panel includes a second segment extending from the first segment and generally perpendicular to the first segment.

6. The building according to claim 5, wherein the first end of the first panel includes a third segment extending from the second segment and generally perpendicular to the second segment.

7. The building according to claim 1, further including a third wall layer positioned at least in part over the first wall layer.

8. The building according to claim 7, further including at least one reinforcing member adjacent the third wall layer.

9. The building according to claim 8, wherein a portion of the reinforcing member is located between the first and third wall layers.

10. The building according to claim 8, wherein the third wall layer includes at least one edge and a portion of the reinforcing member surrounds the edge at least in part.

11. The building according to claim 8, further including a fourth wall layer positioned at least in part over the third wall layer and a fastener extending through the fourth wall layer and into the reinforcing member.

12. The building according to claim 11, further including a fifth wall layer positioned at least in part over the fourth wall layer.

13. The building according to claim 1, wherein the third panel has a first end that forms at least a portion of a second stud with a first end of the fourth panel.

14. The building according to claim 13, wherein the fourth panel has a second end that forms at least a portion of a third stud with one of the ends of the first panel.

15. The building according to claim 1, where in the first wall includes a third wall layer having an end an inwardly facing surface, the second wall includes a fourth wall layer having an end and an inwardly facing surface and the end of the third wall layer abuts the inwardly facing surface of the fourth wall layer.

* * * * *